United States Patent [19]

Schmidt et al.

[11] Patent Number: 4,687,438

[45] Date of Patent: Aug. 18, 1987

[54] SHAFT MELTING FURNACE FOR MELTING METALS

[75] Inventors: Gunther Schmidt, Waldbrol; Joseph W. M. Koch, Wiehl, both of Fed. Rep. of Germany

[73] Assignee: W. Strikfeldt & Koch GmbH, Fed. Rep. of Germany

[21] Appl. No.: 853,629

[22] Filed: Apr. 18, 1986

[30] Foreign Application Priority Data

Apr. 19, 1985 [DE] Fed. Rep. of Germany ..... 3514681

[51] Int. Cl.[4] ..... F27D 19/00

[52] U.S. Cl. ..... 432/57; 432/156; 432/161; 266/214

[58] Field of Search ..... 432/156–161, 432/250, 252, 57; 266/240, 214, 283

[56] References Cited

U.S. PATENT DOCUMENTS

| | | | |
|---|---|---|---|
| 1,092,938 | 4/1914 | Mellen | 266/214 |
| 1,638,812 | 8/1927 | Maehler et al. | 432/57 |
| 1,796,871 | 3/1931 | Madorsky | 266/214 |
| 2,161,181 | 6/1939 | Marx | 266/214 |
| 2,436,124 | 2/1948 | Sklenar | 266/214 |
| 2,527,144 | 10/1950 | Meacham et al. | 432/161 |
| 2,991,060 | 7/1961 | Sklenar | 432/160 |
| 3,129,932 | 4/1964 | Richaud | 432/161 |
| 3,188,065 | 6/1965 | Hoffmann et al. | 266/214 |
| 3,317,310 | 5/1967 | DeLaval, Jr. | 266/214 |
| 3,379,424 | 4/1968 | Dell'Agnese et al. | 432/57 |
| 3,539,169 | 11/1970 | Higgs | 432/161 |

*Primary Examiner*—Henry C. Yuen

*Attorney, Agent, or Firm*—Basile, Weintraub & Hanlon

[57] ABSTRACT

A shaft melting furnace for melting metals is proposed with an interior receiving the molten bath, a charging shaft for supplying the melting stock and a burner supplying heat to the latter. The charging shaft is funnel-shaped and passes into a melting zone of constant cross-section leading to a melting bridge.

7 Claims, 1 Drawing Figure

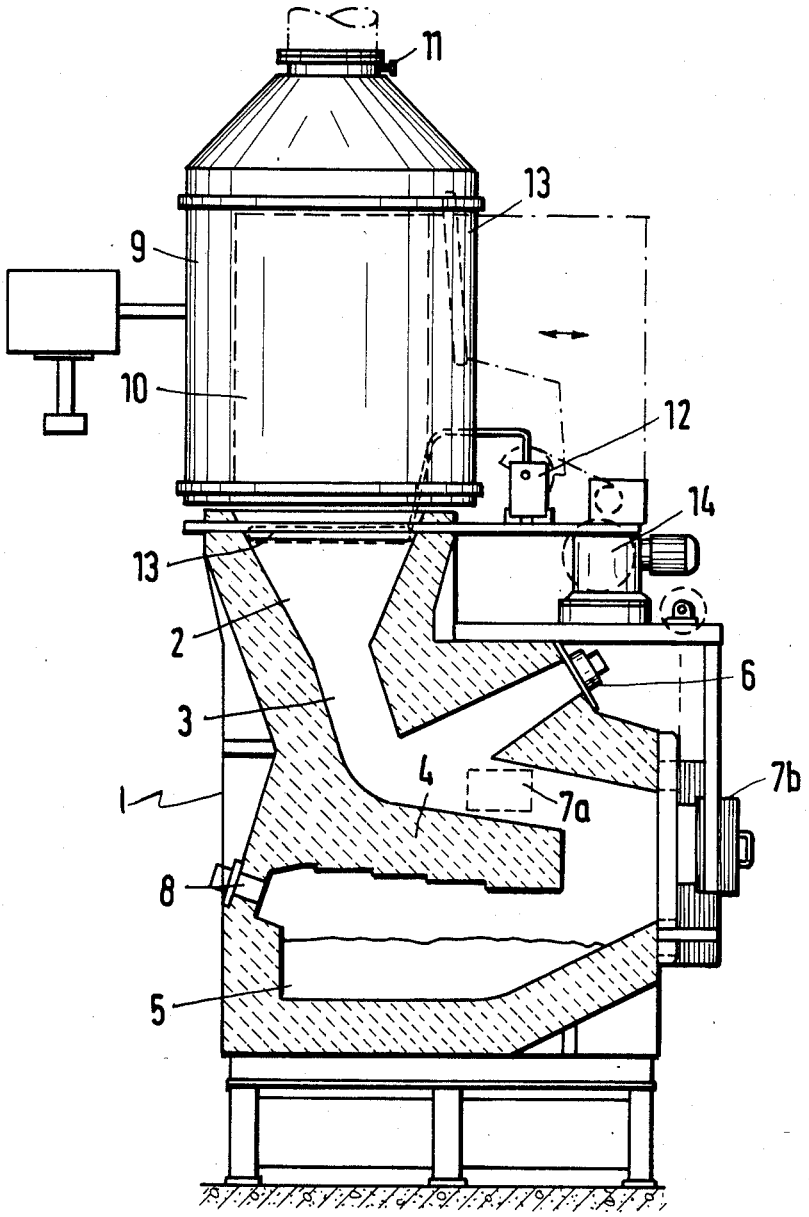
11
13
9
10
12
14
13
2
6
3
4
7a
7b
1
8
5

SHAFT MELTING FURNACE FOR MELTING METALS

BACKGROUND OF THE INVENTION

1. Field of the Invention

The present invention relates to a shaft melting furnace for melting metals and, particularly, for melting non-ferrous metals.

2. Description of the Prior Art

Shaft furnaces are known (U.S. Pat. No. 2,991,060) in which a substantially vertically arranged charging shaft leads directly into a tub or trough-shaped interior receiving the molten bath. A burner faces the charging shaft, the burner heat being passed in such a way through the furnace interior that it is in particular effective at the lower end of the charging shaft and melts the metal located there, so that it flows into the molten bath located in the interior.

In this known shaft furnace it may occur that during charging or even during the melting process, the solid or partly melted melting stock drops into the molten bath before it has completely melted, so that possibly relatively solid components may collect in the molten bath. Impurities can enter the molten bath together with the solid components which would burn in the case of a complete melting process. In addition, in the known shaft furnaces, it can occur that melting stock sticks in the charging shaft, so that the lower region of the latter is melted free and then the burner energy is no longer sufficient to melt loose the melting stock which has stuck above it. It is then necessary to use manually operated tools to advance the melting stock. Thus, these known furnaces cannot be used in an automatic melting process.

SUMMARY OF THE INVENTION

The present invention provides a shaft furnace, which has clearly defined, constant and safe operating conditions and can consequently be incorporated into an automatically performed melting operation and which as a result of the better energy utilization operates more economically with the molten bath being free from impurities.

The combination of the features of the funnel-shaped charging shaft, which passes into a melting zone of constant cross-section, to which is connected a melting ramp and the burner means, arranged roughly level with the melting zone, leads to clearly defined, melting and operating conditions, so that no longer are manual activities required during the desired melting operation, because the shaft furnace can be provided with an automatic charging means and consequently can be integrated into a fully automatic melting sequence and a continuous melting operation is made possible. The inventive arrangement also leads to a considerable energy savings. The funnel-shaped charging shaft shape leads to the melting stock fragments sliding better, so that the melting stock is beginning to melt by the upwardly flowing hot waste gases and slides downwards into the melting zone. The speed of the upwardly flowing gases is reduced not only as a result of the heat exchange on the downwardly flowing molten stock, but also due to the funnel-shaped construction of the charging shaft and the resulting cross-sectional enlargement of the shaft in the upwards direction, so that the waste gases spend longer in the shaft and a better heat utilization is obtained, so that constant, low waste gas temperatures are ensured throughout the melting process. In addition, the speed reduction helps to ensure that dust particles adhering to the melting stock are not entrained and ejected into the upper shaft part and are instead burned in the lower region.

As a result of the inventive construction of the funnel-shaped charging shaft with the following melting zone of constant cross-section, the melting stock slides constantly into said zone and closes same until the melting stock has been completely melted. As a result of the melting ramp following onto said zone and which is constructed as a "dry bridge", the melting stock cannot drop into the molten bath and is instead completely sealed in said zone with the following melting ramp, via which the liquid melt flows into the molten bath. Thus, adhering particles, emulsions and the like burn before they can enter the molten bath and contaminate the melt.

Moreover, unlike in the prior art, it is possible to use moist melting stock, because the latter does not pass into the molten bath where it could lead to explosions. Therefore bath supercooling by the cold melting stock is not possible.

In the case of melting stock with a low melting point, e.g. aluminum, it is possible without difficulty to melt in parts containing metals with a higher melting point, e.g. iron-containing aluminum parts, because the iron parts remain on the melting ramp and can subsequently be easily removed. This also applies with regards to the scratches present and other impurities, such as molding sand residues. Thus, there is no alloying on or adulteration of the melt to the extent that it becomes unusable.

As a result of the clear separation between the melting chamber and the molten bath or heat-maintaining chamber and the arrangement of the melting burner means in the vicinity of the melting zone, no overheating of the molten bath is possible because, unlike in the prior art, the burner flame does not pass into the melting shaft via the molten metal of the molten bath. The size of the melting zone, i.e. its height and cross-sectional surface, is fixed in accordance with the burner flame of the selected burner means, while taking account of the required burner capacity, i.e. the melting efficiency of the shaft furnace. Thus, the efficiency of the plant is maximized, i.e. during melting no melting stock remains unmelted in the active zone or at the transition point between the latter and the melting ramp, so that the melting stock can continuously slide out of the charging shaft.

Advantageous further developments and improvements can be gathered from the following specification.

BRIEF DESCRIPTION OF THE DRAWING

The invention is described in greater detail hereinafter relative to non-limitative embodiments and the attached drawing, wherein the sole FIGURE illustrates a sectional view of one example of the present invention in the form of a shaft furnace with a waste gas dome.

DETAILED DESCRIPTION OF THE PREFERRED EMBODIMENTS

The sole FIGURE illustrates a shaft melting furnace 1 having a charging shaft 2, which is funnel shaped. To the charging shaft 2 is connected a melting zone 3, which has a constant cross-section and slopes slightly with respect to the vertical. To zone 3 is connected a melting ramp 4, which preferably slopes slightly, e.g. by 8° with respect to the horizontal. Below melting ramp 4 there is a molten bath-receiving furnace interior constructed as a heat-maintaining area 5. In the vicinity of zone 3 and melting ramp 4 there is provided a burner means 6 in the form of an oil or gas burner, which is directed onto the transition region between the zone 3 and the melting ramp 4, so that the lower end of the former passes fully into the action zone of the burner means 5. In the vacinity of melting ramp 4 there is provided cleaning openings *7a, 7b* to permit the removal of impurities or the like located on ramp 4. A heat-maintaining burner 8 directed onto the molten bath is arranged in the side walls of the heat-maintaining area 5.

In the represented embodiment the heat-maintaining area 5 is located below the melting ramp 4. However, obviously, in accordance with the construction of the furnace, said heat-maintaining area can be positioned in front of or to the side of the melting ramp. The arrangement of the burner means 6 and zone 3 can also be modified in accordance with constructional conditions of the furnace, i.e. according to the operating conditions the zone 3 can be continued directly and vertically below the funnel-shaped charging shaft 2. As a function of the furnace shape, the burner means 6 can be positioned at different points in the circumference of the furnace roughly level with zone 3.

To the funnel-shaped charging shaft 2 is connected a waste gas dome 9, which is provided with a sliding door 10. Above dome 9 is provided a temperature measurement point 11. Between the waste gas dome 9 and charging shaft 2 is provided a shaft cover 13 drivable by a motor 12 and which can be pivoted as a function of the desired operating conditions.

On charging the charging shaft 2 with melting stock, the latter slides into the melting zone 3, its packing density being very high. The burner 6 directed onto the transition region between zone 3 and melting ramp 4, optionally via deflecting means, melts the melting stock, which flows down the ramp and into the interior 5. The hot waste gases of burner 6 rise in zone 3 and also melt the melting stock. As the size of zone 3 is adapted to the burner flame of the burner means, while taking account of the required melting or burner capacity, the lower part of the zone is melted free, so that the melting stock present in the funnel-shaped charging shaft 2 can slide on, the zone remaining closed until the melting stock has completely melted. The sloping faces of the funnel-shaped charging shaft 3 aid this sliding action. The waste gases flow upwards and melt the melting stock at least partly and then leave, from the upper end of shaft 2, after giving off heat and passing into the waste gas dome 9.

During the melting operation, the waste gas temperature is monitored at temperature measuring point 11. If the zone 3 has been melted free, the waste gas temperature rises, which shows that charging shaft 2 is free for a further charging process. The charging apparatus 16 comprises a charging container 18 and a lifting means 20. On reaching the preselected waste gas temperature, sliding door 10 is opened by means of a motor 14 and the charging container 18 rises and simultaneously passes through an electromechanical inspection point showing the open sliding door 10. By means of a switch, simultaneously a fixed-cycle or timed charging is initiated, i.e. the filled container 18 passes with set intervals and running times into the end tilting position. After the container 18 has been emptied, it returns and passes downwards by means 20 of the lifting means, the sliding door 10 closing automatically.

If for any reason the charging process is not to be started, by means of a preselected, set maximum waste gas temperatrue and at the end of a time set on a timing element, the melting burner is switched off and and optical or acoustic signal is supplied, which indicates the need for re-charging.

In the shaft furnace according to the drawing, the melting area and the heat-maintaining area are superposed. In another mode the melting area and the heat-maintaining area are arranged side by side and they are separated by a wall having a small opening for the passage of the molten metal from the melting area to the heat-maintaining area.

The shaft furnace shown in the drawing has a rectangular form of the furnace casing. Also other forms can be provided, e.g. round or oval forms.

What is claimed is:

1. A shaft melting furnace for melting metals with a heat-maintaining area receiving the molten bath comprising a charging shaft for supplying the melting stock. and a burner means providing heat to the melting stock, the charging shaft having a funnel-shaped construction and being connected to a melting zone of constant cross-section leading to a melting ramp included slightly with respect to the horizontal, with a transition zone therebetween formed by a lower end of the melting zone, the burner means being arranged in the vicinity of said zone and its action being fully directed onto the transmission, with a cleaning door in the vicinity of the melting ramp provided for removing residue, wherein the melting zone with melting ramp and heat-maintaining area are superposed.

2. The shaft furnace according to claim 1, wherein the melting zone is inclined to the vertical.

3. The shaft furnace according to claim 1, further comprising means for determining the waste gas temperature at a point above the charging shaft.

4. The shaft furnace according to claim 3, further comprising an automatic charging means which is controlled as a function of the waste gas temperature.

5. A shaft melting furnace for melting metals with a heat-maintaining area receiving the molten bath comprising a charging shaft for supplying the melting stock and a burner means providing heat to the melting stock, the charging shaft having a funnel-shaped construction and being connected to a melting zone of constant cross-section leading to a melting ramp inclined slightly with respect to the horizontal, with a transition zone therebetween formed by a lower end of the melting zone, the burner means being arranged in the vicinity of said zone and its action being fully directed onto the transmission, with a cleaning door in the vicinity of the melting ramp provided for removing residue, wherein the melting zone with melting ramp and heat-maintaining area are arranged side-by-side being separated by a wall with an opening for the passage of the molten metal.

6. The shaft furnace according to claim 5, further comprising means for determining the waste gas temperature at a point above the charging shaft.

7. The shaft furnace according to claim 6, further comprising an automatic charging means which is controlled as a function of the waste gas aperture.

* * * * *